US005977960A

United States Patent [19]

Nally et al.

[11] Patent Number: 5,977,960

[45] Date of Patent: Nov. 2, 1999

[54] APPARATUS, SYSTEMS AND METHODS FOR CONTROLLING DATA OVERLAY IN MULTIMEDIA DATA PROCESSING AND DISPLAY SYSTEMS USING MASK TECHNIQUES

[75] Inventors: Robert Marshall Nally, McKinney; John C. Schafer, Wylie, both of Tex.

[73] Assignee: S3 Incorporated, Santa Clara, Calif.

[21] Appl. No.: 08/707,937

[22] Filed: Sep. 10, 1996

[51] Int. Cl.[6] ..... G09G 5/36

[52] U.S. Cl. ..... 345/191; 345/501; 345/507; 345/113

[58] Field of Search ..... 345/418, 302, 345/433, 434, 435, 112, 113, 114, 115, 118, 150, 152, 154, 328, 329–332, 340, 342, 501–503, 520, 521, 523, 524, 507, 188, 509, 515, 191, 516, 512, 186, 510

[56] References Cited

U.S. PATENT DOCUMENTS 5,257,348 10/1993 Roskowski et al. ..... 345/327
5,398,309 3/1995 Atkins et al. ..... 345/435
5,469,541 11/1995 Kingman et al. ..... 345/509
5,506,604 4/1996 Nally et al. ..... 345/154
5,590,254 12/1996 Lippincott et al. ..... 345/435
5,604,514 2/1997 Hancock ..... 345/154

*Primary Examiner*—U. Chauhan
*Attorney, Agent, or Firm*—Fenwick & West LLP

[57] ABSTRACT

A memory system 107,300 is provided which includes a memory 107 having a data area for storing data words and a mask area 302 for storing a control mask. Mask generation circuitry 301 is provided for generating such a control mask for storage in the mask area 302 of the memory 107. Mask controlled memory read control circuitry 303 is provided which is operable to selectively retrieve from the mask area 302 bits of the mask stored therein and in response selectively retrieve and output data words stored in the data area of the memory 107.

15 Claims, 4 Drawing Sheets

MASK READ I/O REQUEST
MEMORY ADDRESS BUS
MASK READ I/O GRANT
VDW1 ACTIVE
MASK OBJECT FROM FRAME BUFFER 107
VIDEO READ I/O REQ
TO OVERALY SELECTOR
VIDEO READ I/O GRANT
MASK OBJECT READ ADDRESS GENERATOR
DISPLAY POSITION CONTROLS
X COUNT
Y COUNT
MEMORY MAPPER
GRAPHICS MEMORY BASE ADDRESS
64 BIT MASK REGISTER
VDW 1
VDW 2
MEMORY MAPPER
BASE ADDRESS
504
505
506
507
508
509
510
511
512
515
516
517
500
501
502
503
209
210
303

APPARATUS, SYSTEMS AND METHODS FOR CONTROLLING DATA OVERLAY IN MULTIMEDIA DATA PROCESSING AND DISPLAY SYSTEMS USING MASK TECHNIQUES

TECHNICAL FIELD OF THE INVENTION

The present invention relates in general to multimedia processing and display systems and in particular to apparatus, systems and methods for controlling data overlay in multimedia processing and display systems using mask techniques.

BACKGROUND OF THE INVENTION

As multimedia information processing systems increase in popularity, system designers must consider new techniques for controlling the processing and display of data simultaneously generated by multiple sources. In particular, there has been substantial demand for processing systems which have the capability of concurrently displaying both video and graphics data on a single display screen. The development of such systems presents a number of design challenges, not only because the format differences between graphics and video data must be accounted for, but also because of end user driven requirements that these systems allow for flexible manipulation of the data on the display screen.

One particular technique for simultaneously displaying video and graphics data on a single display screen involves the generation of "windows." In this case, a stream of data from a selected source is used to generate a display within a particular region or "window" of the display screen to the exclusion of any nonselected data streams defining a display or part of a display corresponding to the same region of the screen. The selected data stream generating the display window "overlays" or "occludes" the data from the nonselected data streams which lie "behind" the displayed data. In one instance, the overall content and appearance of the display screen is defined by graphics data and one or more "video windows" generated by data from a video source occlude a corresponding region of that graphics data. In other instances, a video display or window may be occluded or overlaid by graphics data or even another video window.

In the multimedia environment, the "windowing" described above yields substantial advantages. Among other things, the user can typically change the size and location on the display screen of a given window to flexibly manipulate the content and appearance of the data being displayed. For example, in the case of combined graphics and video, the user can advantageously create custom composite visual displays by combining multiple video and graphics data streams in a windowing environment.

Significantly, occluded video windows cannot be managed by software alone, as can occluded graphics windows. Special hardware windowing controls are required because video data is constantly being updated whereas graphics data is updated (painted) only once.

In order to efficiently control windows in a multimedia environment, efficient frame buffer management is required. Specifically, a frame buffer control scheme must be developed which allows for the efficient storage and retrieval of multiple types of data, such as video data and graphics data. To be cost competitive as well as functionally efficient, such a scheme should minimize the number of memory devices and the amount of control circuitry required and should insure that data flow to the display is subjected to minimal delay notwithstanding data type.

Thus, due to the advantages of windowing, the need has arisen for efficient and cost effective windowing control circuitry. Such windowing circuitry should allow for the simultaneous processing of data received from multiple sources and in multiple formats. In particular, such windowing control circuitry should be capable of efficiently and inexpensively controlling the occlusion and/or overlay of video and graphics data in a windowing environment.

SUMMARY OF THE INVENTION

According to a first embodiment of the present invention, a memory system is provided which includes a memory having a data area for storing data words and a mask area for storing a control mask. The mask in this embodiment is an occlusion mask. The mask will determine which pixels in the video window are graphics pixels (overlaid) and which are video pixels on a pixel-by-pixel basis. The control mask is an occlusion mask which determines which pixels in the video window are graphics pixels (overlaid) and which are video pixels on a pixel-by-pixel basis. Mask generation circuitry is provided which generates a control mask for storage in the mask area of the memory. Mask controlled memory read control circuitry is provided which is operable to then selectively retrieve from the mask area bits of the mask and in response selectively retrieve and output data words stored in the data area of the memory.

According to a second embodiment according to the principles of the present invention, an overlay control system is provided which includes a frame buffer for storing words of graphics and video data and an overlay control mask. Mask generation circuitry generates such a mask for storage in the frame buffer. Mask controlled overlay circuitry is provided which is operable in response to bits of the mask retrieved from the frame buffer to selectively retrieve and output words of the video data stream stored in the frame buffer.

According to a third embodiment of the present invention, a display system is provided which includes a display device for generating a display on a display screen and a frame buffer. Graphics data processing circuitry is further provided for processing a graphics data stream, the graphics data processing circuitry controlling the transfer of graphics data to and from a graphics memory area in the frame buffer. Mask generation control circuitry is included for generating a mask for storage in a mask object area of the frame buffer. Video data processing circuitry is provided for processing a video data stream and includes mask controlled circuitry operable in response to bits of the mask retrieved from the frame buffer to selectively retrieve words of the video data stream stored in the frame buffer. Finally, mask controlled output selection circuitry is provided for selecting for output to the display device in response to the bits of the mask between words of the graphics data retrieved from the frame buffer by the graphics processing circuitry and words of the video data retrieved from the frame buffer by the video processing circuitry.

The embodiments of the present invention provide significant advantages over the prior art. In particular, the principles of the present invention allow for efficient and cost-effective windowing a multimedia environment. Specifically, windowing control circuitry embodying the principles of the present invention provides for the efficient and inexpensive control of occlusion/overlay of video and graphics data in a windowing environment.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Figure 1:
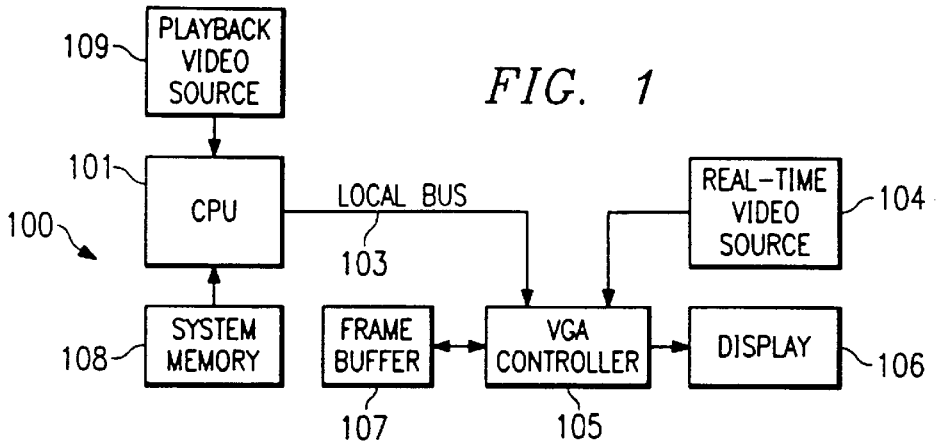
FIG. 1 is a high level functional block diagram of a processing and display system embodying the principles of the present invention.

FIG. 1 is a high level functional block diagram of a multimedia processing and display system 100 operable to process and simultaneously display both graphics and video data according to the principles of the present invention. Display system 100 includes a central processing unit (CPU) 101 which controls the overall operation of system 100 and generates graphics data defining graphics images to be displayed. CPU 101 communicates with the remainder of the system discussed below by a local bus 103. A real-time video source 104 is coupled to the VPORT of VGA controller 105 which provides digitized video data in real-time to be processed and displayed by system 100. Real-time video source 104 may be, for example, a real-time video data source outputting video data in a YUV format. System 100 operates in conjunction with a system memory 108 which stores graphics and video data on a real-time basis. System memory 108 may be for example a random access memory (RAM), floppy disk, hard disk or other type of storage device. A playback video (non-real-time) source 109 is provided coupled to CPU 109 via a local bus. Playback video source 109 maybe for example a MPEG decoder or other video source converting compressed data into a YUV or RGB format.

A VGA controller 105 embodying the principles of the present invention is coupled to local bus 103. VGA controller 105 will be discussed in detail below; however, VGA controller 105 generally interfaces CPU 101 with real-time video source 104 and playback video source 109 with a display unit 106 and a multi-format system frame buffer 107. Frame buffer memory 107 provides temporary storage of the graphics and video data during processing prior to display on display unit 106. According to the principles of the present invention, VGA controller is operable in selected modes to store graphics and video data together in frame buffer 107 in their native formats. In a preferred embodiment, the frame buffer area is partitioned into video memory which generally includes those areas of the memory used for storing YUV formatted data, a graphics memory which generally includes those areas of the frame buffer used for storing RGB formatted data, and a mask memory. In the preferred embodiment, display unit 106 is a conventional raster scan display device and frame buffer 107 is constructed from dynamic random access memory devices (DRAMs).

Figure 2:
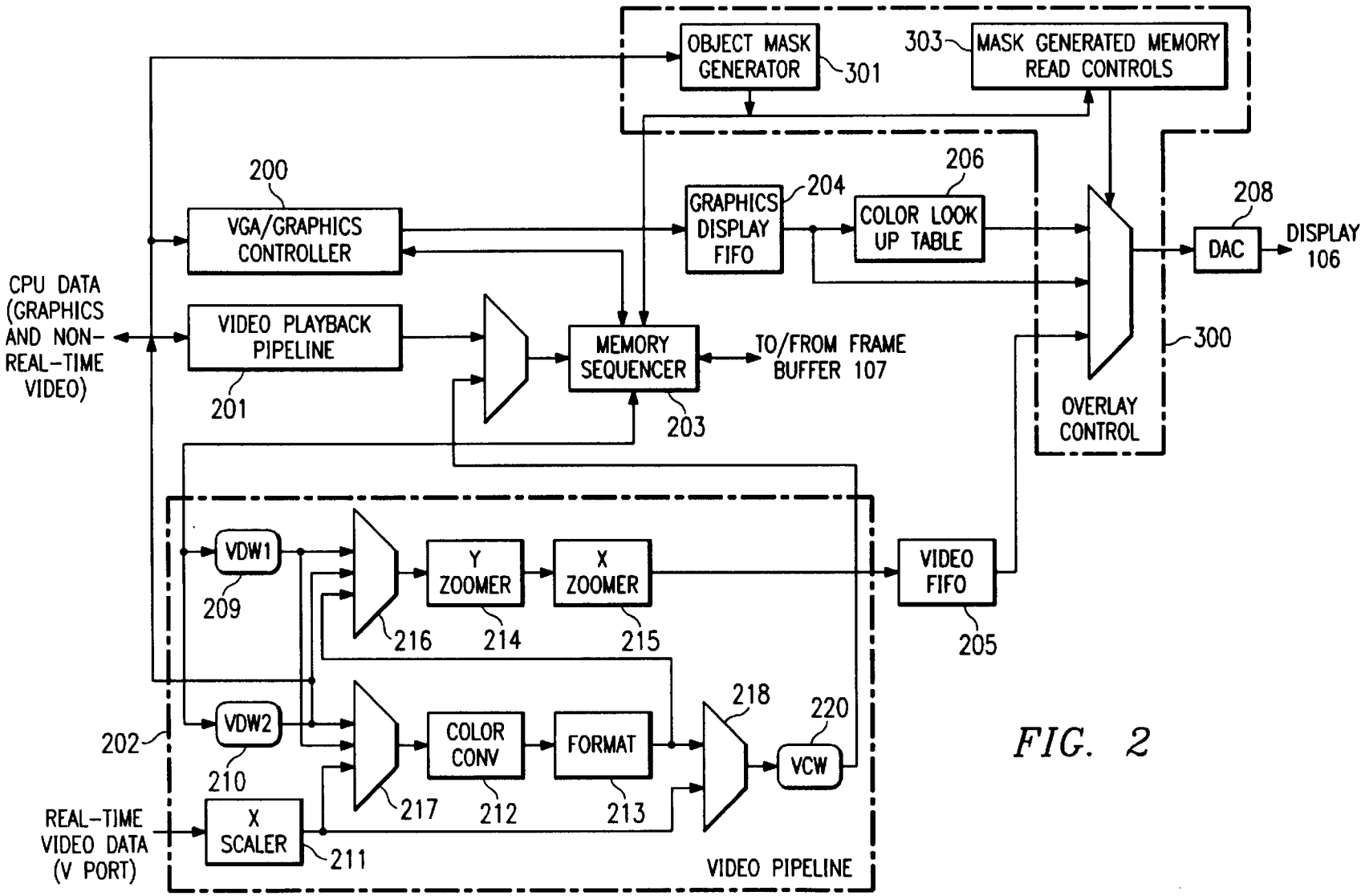
FIG. 2 is a detailed functional block diagram of the VGA controller depicted in FIG. 1.

FIG. 2 is a detailed functional block diagram emphasizing VGA controller 105 and the associated circuitry interfacing controller 105 with frame buffer 107 and display unit 106. The primary components of VGA controller 105 include a conventional VGA/graphics controller 200, a video playback pipeline 201 and a video pipeline 202. VGA/graphics controller 200 receives graphics data from CPU 101 and in conjunction with frame buffer 107 performs additional processing, for example color expansion, on that graphics data prior to delivery to the graphics display FIFO 204. Video playback pipeline 201 interprets a file format containing video encoded into video data. Such pipelines are known in the art and are designed in response by the file format. Video pipeline 202, among other things, receives real-time video data from video source 107 and stores the received video data in the video areas of the frame buffer memory. In addition, video pipeline 202 controls the retrieval from memory and passage through overlay controls 207 of the video data (either real-time or playback) to generate a "window" on the display screen. Video pipeline 202 is further operable to convert received YUV data (either from frame buffer 107 directly or video source 104) into RGB data and perform X and Y zooming on video data being sent to display 106.

A memory sequencer 203 controls and arbitrates accesses to and from frame buffer 107 by VGA/graphics controller 200, video playback pipeline 201, and video pipeline 202. Graphics data output from VGA/graphics controller 200 is buffered and synchronized with the clocks controlling display 104 by a graphics first-in/first-out memory (FIFO) 204 while video data output from video pipeline 202 is buffered and synchronized with the clocks controlling display 104 by video first-in/first-out (FIFO 205). The graphics data stream output from graphics FIFO 204 may be used to either address a color look-up table 206, the output of which is provided to the inputs of an overlay selector 207, or may be passed directly to the inputs of overlay selector 207 as true color data. The inputs of overlay selector 207 also receive the video data stream output from video FIFO 205. The selected data output from overlay selector 207 is provided to the input of a digital analog converter (DAC) 208 which drives display monitor 106. The operation and control of overlay selector 207 will be discussed in further detail below.

Video pipeline 202 includes first video window control circuitry (VDW1) 209 and second video control circuitry (VDW2) 210 which control the transfer of video data from frame buffer 107 (via memory sequencer 203). In the preferred embodiment, video window control circuits 209 and 210 each are composed of a series of counters, registers and address generators which control the retrieval of data from the video areas of memory for generation of respective display windows. An x-scaler 211 is provided to compress incoming real-time YUV video data corresponding to a display line of pixels (i.e., along the x-axis of the display). X-scaler may for example use a truncation/error diffusion technique for data compression. A color converter 212 and formatter 213 are provided to convert video data, received either directly from x-scaler 211 or after storage and retrieval from frame buffer 107, from the native YUV format to an RGB format compatible with DAC 208. A y-zoomer 214 and an x-zoomer 215 are provided to expand RGB pixel data on a pixel-by-pixel basis along a given display row (x-zooming) and/or on a display line by display line basis (i.e., y-zooming). Interconnection/multiplexing circuits 216–218 allow for the flexible processing of video data as will be discussed below. Video capture window control circuitry (VCW) 220 controls the transfer of incoming video data, either in its original YUV form or following conversion to an RGB format, to the frame buffer 107. In the preferred embodiment, video window control circuitry is constructed as a series of counters, registers, and address generators.

Interconnection/multiplexing circuits 216–218, along with video window control circuitry 209 and 210 and video capture window control circuitry 220, advantageously allow for the flexible processing of incoming video data under the control of the system software being executed by CPU 101. For example, during video capture in an RGB format, incoming YUV video data is first passed through x-scaler 211 for compression (as required), and then through color converter 212 and formatter 213 for conversion and reformatting into a selected RGB format. The RGB data is then, under the control of video capture window control circuitry 220, stored in frame buffer 107 as RGB data. In the illustrated embodiment, video display window controller (VDW2) 210 controls the subsequent retrieval of the RGB data from frame buffer 107 for delivery to display 106 while video display window controller (VDW1) 209 controls the transfer of the RGB video data from the frame buffer 107 to CPU 101 via local bus 103 for processing.

Video data can also be captured in a YUV format. In this case, the incoming video data stream is passed only through x-scaler 211 for compression (as required) and then sent directly to frame buffer 107 in its original YUV format. Video capture window control circuitry 220 controls the input of the video data stream and the subsequent storage of the data in frame buffer 107 after x-scaling. In the illustrated embodiment, video window control circuitry 209 (VDW1) is used during video capture in a YUV format to control data retrieval from frame buffer 107. Following retrieval from frame buffer 107, the YUV data is sent to color converter 212 and formatter 213 for conversion and formatting into RGB data and then on through y-zoomer 214 and x-zoomer 215 to overlay control circuitry 207. Video window controller 210 (VDW2) in this example controls the delivery of the converted data to CPU 101 via local bus 103 for further processing.

Figure 3:
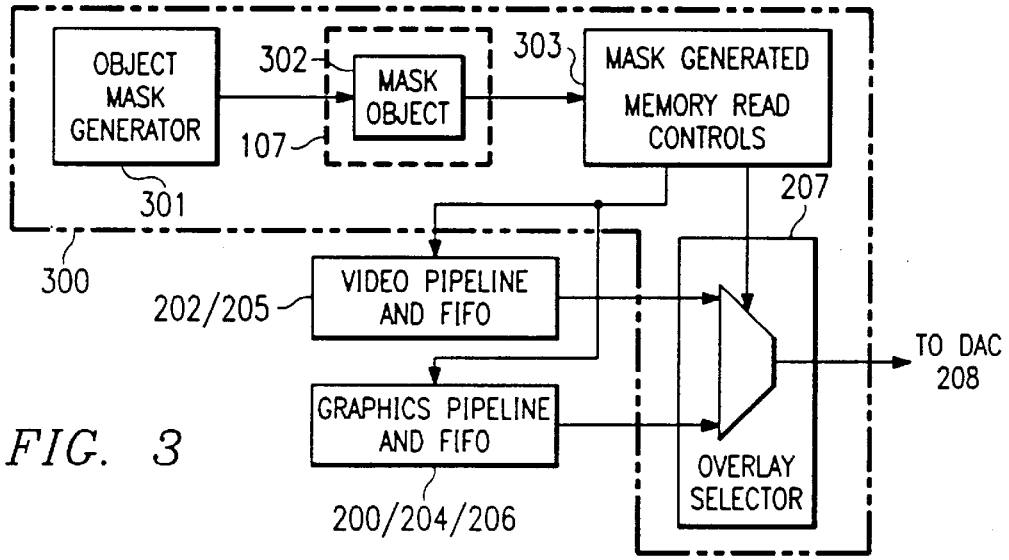
FIG. 3 is a functional block diagram depicting a mask controlled overlay control system according to the principles of the present invention.

FIG. 3 is a high-level functional block diagram emphasizing mask controlled overlay circuitry 300 of system 100 constructed in accordance with the principles of the present invention. Mask controlled overlay circuitry 300 includes an object mask generator (OMG) 301, mask object 302 which is stored in frame buffer memory 107, mask generated memory read controls (MGMRC) 303 and overlay selector/controls 207. Mask object 302 in the preferred embodiment comprises a selected space in frame buffer 107. Object mask generator 301 and mask generated memory read controls 303 will be described in detail below. In general, an overlay control mask is generated by object mask generator 301 and stored in mask object 302. When memory sequencer 203 is rastering data out of frame buffer 107 to refresh the screen on display 106, and the pixel position of the raster data begins to match the pixel position of pixels in a "window of interest" as defined by VDW1 or VDW2 on the screen, mask generated read controls 303 are evoked. Mask generated memory read controls 303, using the mask in mask object 302 select which from area (i.e. video or graphics) in multi-format frame buffer 107 raster data will be retrieved. Mask generated memory controls of 303 also maintain a "data steering switch" FIFO (discussed below) that controls whether video data passing through a video pipeline 202 and video FIFO 205 or graphics data output from VGA/graphics controller 200 and graphics FIFO 204 is passed to a DAC 208. It should be noted that in the preferred embodiment, mask generated memory read controls 303 always attempt to keep video FIFO 205 full even when the display screen is being refreshed in regions outside a "window of interest" (i.e., graphics data are being displayed) and during sync times. For purposes of the present discussion, a video window of interest is a region of pixels on the display screen where video data is intended to be displayed.

Figure 4:
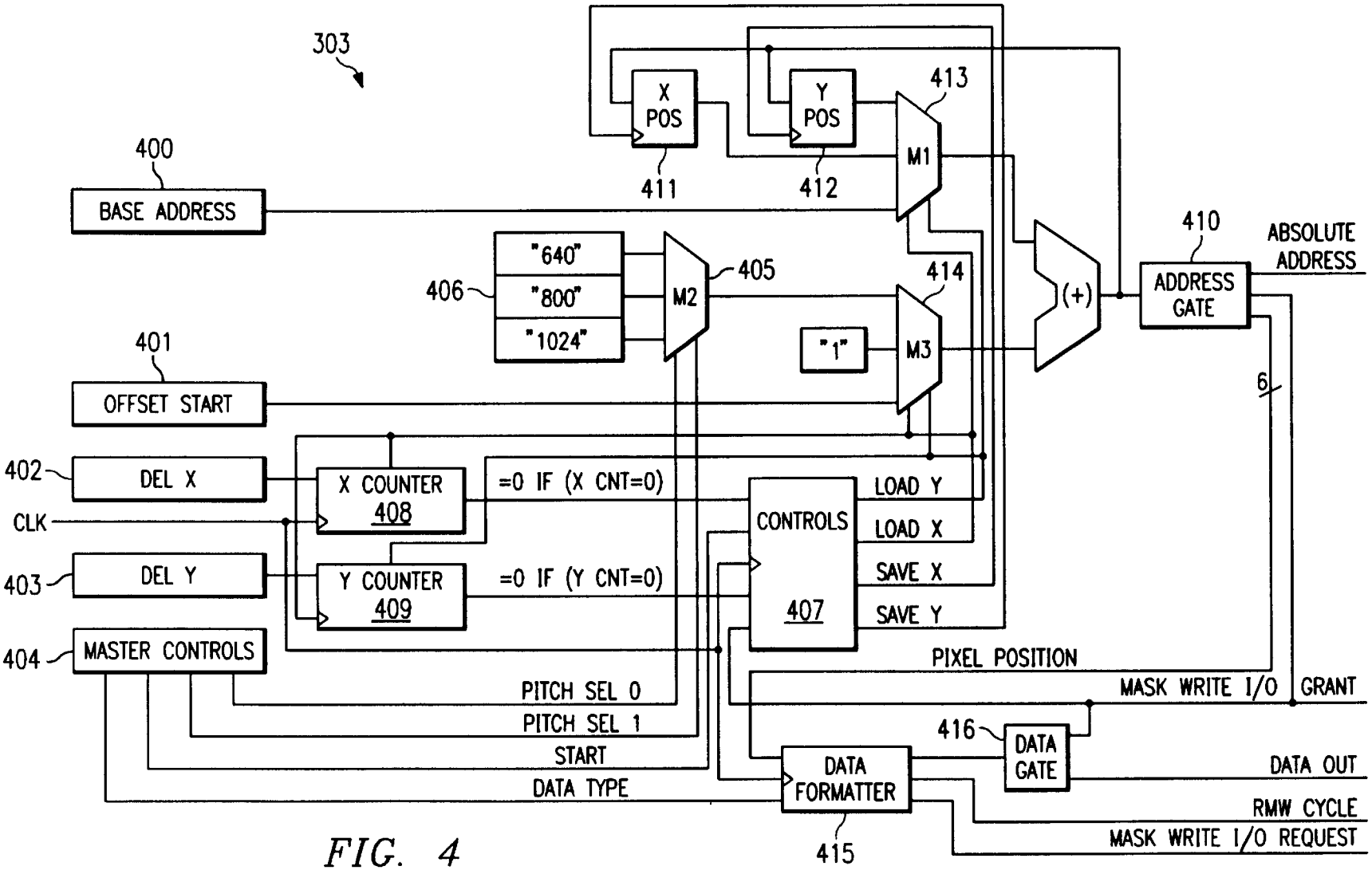
FIG. 4 is a functional block diagram depicting in further detail the object mask generator of FIG. 3.

FIG. 4 is a more detailed functional block diagram of object mask generator 301. Object mask generator 301, under the direction of software being executed by CPU 101, defines the overlay control mask by flooding regions of masked object 302 with a defined one-bit value (either a logic one or a logic zero).

Object mask generator 301 includes a base address register 400, an offset start register 401, a DEL X register 402, a DEL Y register 403 and master controls register 404, each of which is loaded by CPU 101. Base address register 400 maintains a base address to the object mask 302 and offset start register 401 maintains an offset to the address of the starting position or pixel of a portion of the mask that is to be changed or modified. This selected portion of memory will be flood filled with new data. Master controls register 404 holds a START bit, a DATA TYPE bit and PITCH SEL n bits. When the START bit is set to a logic one by CPU 101, a flood fill operation will begin in a selected region of the mask object. The START bit field automatically clears to a logic zero when the flood fill is complete. The DATA TYPE bit determines what data value the selected portion of the mask object region will be flooded with. When a logic one is set into the DATA TYPE bit field, the region is correspondingly filled with logic ones, when a logic zero is set in this bit field the region is filled with logic zeros. The PITCH SEL n bits (in the preferred embodiment there are two such bits) are used to determine the width in pixels of the mask object. In the illustrated embodiment, three resolutions are provided for: 640; 800; and 1024 pixel-wide objects. As shown in FIG. 4, the PITCH SEL 0 and PITCH SEL 1 bits are used to toggle a multiplexer 405 which allows a corresponding mask size value to be passed from hard-wired registers 406. In the preferred embodiment, the offset start register 401, DEL X register 402 and DEL Y register 403 are set up before the START bit is set. Base address register 400 and the PITCH SEL bits of master control register 404 are set up during VGA mode changes.

When the START bit is set to a logic one, the LOAD X and LOAD Y outputs of control circuitry 407 are set high which consequently loads the values in DEL X register 402 and DEL Y register 403 into X down counter 408 and Y down counter 409, respectively. With the first clock (CLK), the output of address gate 410 is set with an absolute address of a 64-bit word in mask object area 302 of frame buffer 107 that contains the first pixel of the first line of a portion of the "window of interest" to be modified. The absolute address includes bits indicating the Pixel Position of that particular pixel within the addressed 64-bit word. Also, with the first clock, LOAD X and LOAD Y return to a low state. It should be noted that the address of the first pixel of the first line of the portion of the mask object that is being modified is the base address from base register 400 plus offset start from offset register 401, as controlled by selectors 413 and 414 in accordance with Table 1. The base address is equal to the selected display width from register 406 times a Y value, a X value, where the top left pixel of the video window is at pixel location (X,Y) as shown in FIG. 4. The absolute address output by address gate 410 is latched in corresponding X position register 411 and Y position register 412.

TABLE I

| Load Y | Load X | M1 Selection | M3 Selection | Addr Generated |
|---|---|---|---|---|
| 0 | 0 | X Pos | "1" | Next pixel in current line |
| 0 | 1 | Y Pos | M2 Output | First pixel in new line |
| 1 | 0 | N/A | N/A | N/A |
| 1 | 1 | Base Address | Offset Start | First pixel in first line |

After the first clock, the value in X counter 408 equals the value in DEL X register 402 and the value in Y counter 409 equals the value in DEL Y register 403. X counter 408 decrements with each clock cycle thereafter until the value in X counter 408 equals zero. At the same time, a logic one is added to the value in X position register 411 with each clock cycle. When X counter 408 decrements to zero, LOAD X goes active (i.e. high) such that x-counter 408 reloads, the value in Y counter 409 decrements, and the address of the first pixel of the next line in the window is set into address gate 410 (i.e. the value held in Y position register 412 plus the output of selector 405) on the very next clock both x-position register 411 and y-position register 412 are updated with this new address and x-counter decrementing begins again. This process repeats until Y counter 409 decrements to zero at which time the operation terminates and START is reset to zero.

Object mask generator 301 also includes a data formatter 415 which in the preferred embodiment includes a 64-bit register. On each clock cycle the DATA TYPE value in the master controls register 404 is written to the bit position in data formatter 415 pointed to by the 6-bit Pixel Position value received from address gate 410. The Pixel Position value output from address gate 410 in the preferred embodiment is represented by the six LSBs of the absolute address. Data formatter 415 counts the number of Pixel Position bits (pixels) as they are loaded into its register and when it has collected 64 bits, generates a mask write I/O request to memory sequencer 203 and places the 64 bits as a data word in data gate 416. When memory sequencer 203 determines that frame buffer 107 is ready to receive this mask data a mask write I/O grant is sent back to data gate 416 and address gate 410 to release the current mask data and current absolute address to frame buffer 107.

Data formatter 415 also manages boundary conditions. For example, if the Pixel Position is not zero and LOAD X is active (the leading boundary is not 64-bit aligned), a flag is set internal to data formatter 415 indicating that the next mask right memory cycle will be a read-modify-write. When the Pixel Position equals 64 or when the value in X counter 408 equals zero, the read-modify-write cycle will occur. If the Pixel Position does not equal 64 when the value in X counter 408 goes to zero (the trailing boundary is not 64-bit aligned) the internal flag is again set, indicating that the next mask right memory cycle will be a read-modify-write. In this case, the read-modify-write cycle occurs immediately. Every time the contents of data formatter 415 are loaded into data gate 416, the entire 64-bits in data formatter 415 are reset to NOT DATA TYPE before the next clock cycle.

Figure 5:
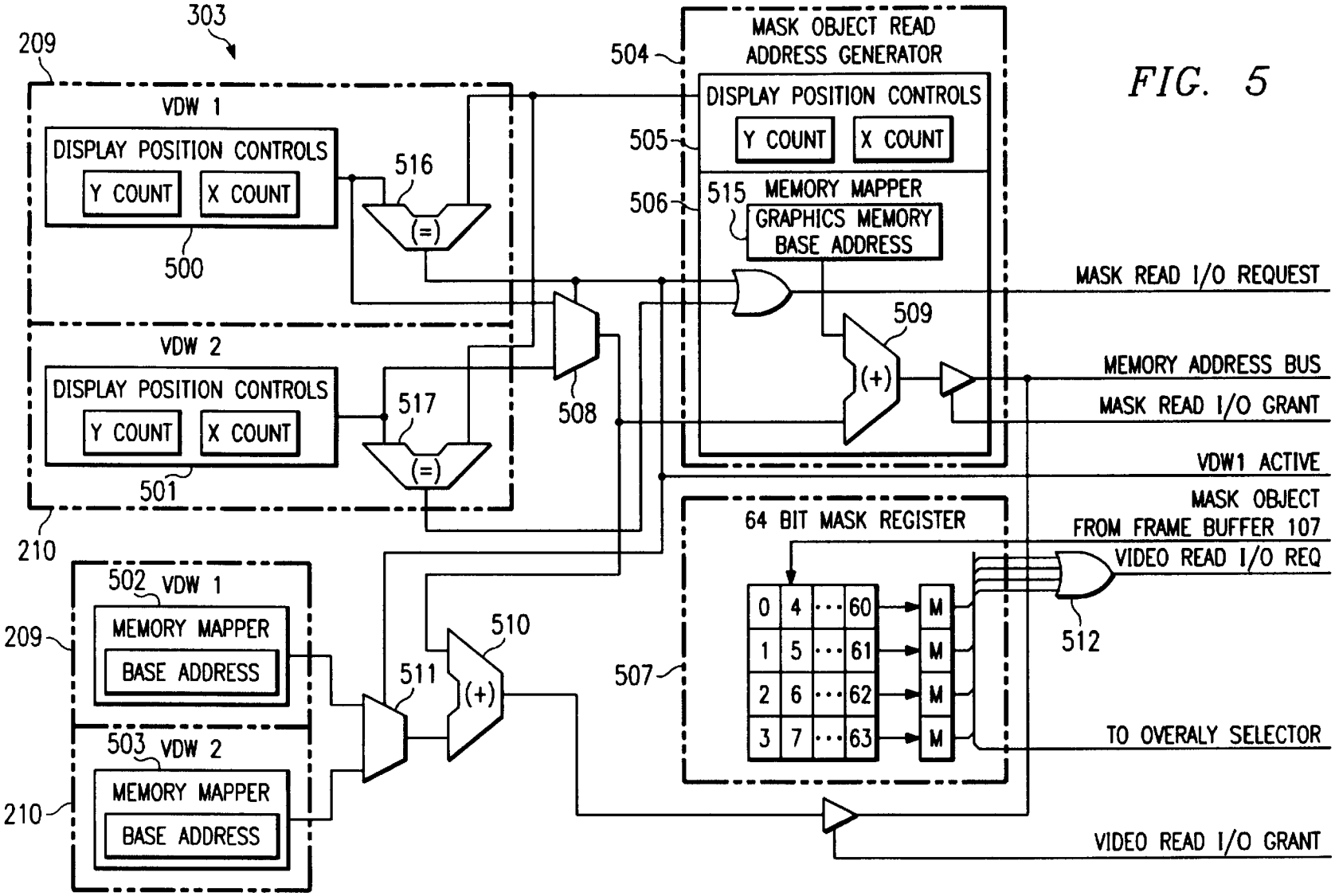
FIG. 5 is a functional block diagram depicting in further detail the mask generated memory read controls of FIG. 3.

FIG. 5 is a more detailed functional block diagram of mask generated memory read controls 303. The primary components of read controls 303 include the display position controls 500 of video window controls circuitry 209 and the display position controls 501 of video window control circuitry 210. Display position controls 500 and 501 include counters and registers which define the regions on the display screen where video windows 1 and video windows 2 will be respectively displayed. The memory mapper 502 of video window 1 control circuitry 209 and the memory mapper 503 of video window 2 control circuitry 210 are used to maintain a base address to the frame buffer 107 address space in which the corresponding video data is being stored. Mask object read address generator 504 includes display position controls 505 and a memory mapper 506. Display position controls 505 include registers and counters which track the position of the current raster scan on the screen of display 106. Memory mapper 506 includes a register 515 which holds the base address to the mask object 302 address space in frame buffer 107. Mask generated memory read controls 303 also includes a 64-bit mask register 507, which will be discussed further below.

When the X and Y counts in either video window 1 display position controls 500 or video window 2 display position controls 501 are equal to the X and Y counts in read address generator display position controls 505, as determined by respective comparison circuitry 516 and 517, the raster scan has reached a video window. In this case, a mask read I/O request is sent to memory sequencer 203 to initiate retrieval of mask bits from mask object 302. The X and Y counts from the active display window position control circuit 500 or 501 are then passed by selector 508 added to the graphics memory base address in register 515 by adder 509 to obtain a memory address to mask object 302. The resulting address is sent to frame buffer 107 via the memory address bus when a mask read I/O grant is received from memory sequencer 203. It should be noted that the counters in VDW1 and VDW2 increment only when the outputs of their corresponding comparators 516 and 517 indicate an equal condition exists, while the counters in display position controls 505 are always counting with the raster scan.

Each address to mask object 302 results in the retrieval of the corresponding 64 mask bits which are stored in mask register 507. Each of the 64 bits are then stored in mask register 507. Four bits representing four pixels are next retrieved at a time from mask register 507 and compared by comparison circuitry 512 (four bits are compared at one time because the width of the frame buffer data path in the preferred embodiment is 4 YUV pixels or 64 bits). If all four bits are a logic zero no video memory read cycle will take place (no video read I/O request is issued). If on the other hand, any one of the four bits being compared is a logic one, a video I/O request is sent to memory sequencer 203. When a Video Read I/O Grant is issued back from memory sequencer 203, a video memory read cycle starting at the address of the first pixel of the four will be generated by adder 510 and sent to frame buffer 107. That address is generated using the active window memory mapper 502 or 503. The X and Y counts for the active video window are passed through multiplexer 508 to an adder 510 and added to the base address from the corresponding memory mapper 502 or 503 of the active video window as selected by a selector 511. The result is an address to the video memory in multi-format frame buffer 107 to retrieve the corresponding video data once a video read I/O grant has been issued by memory sequencer 203.

Figure 6:
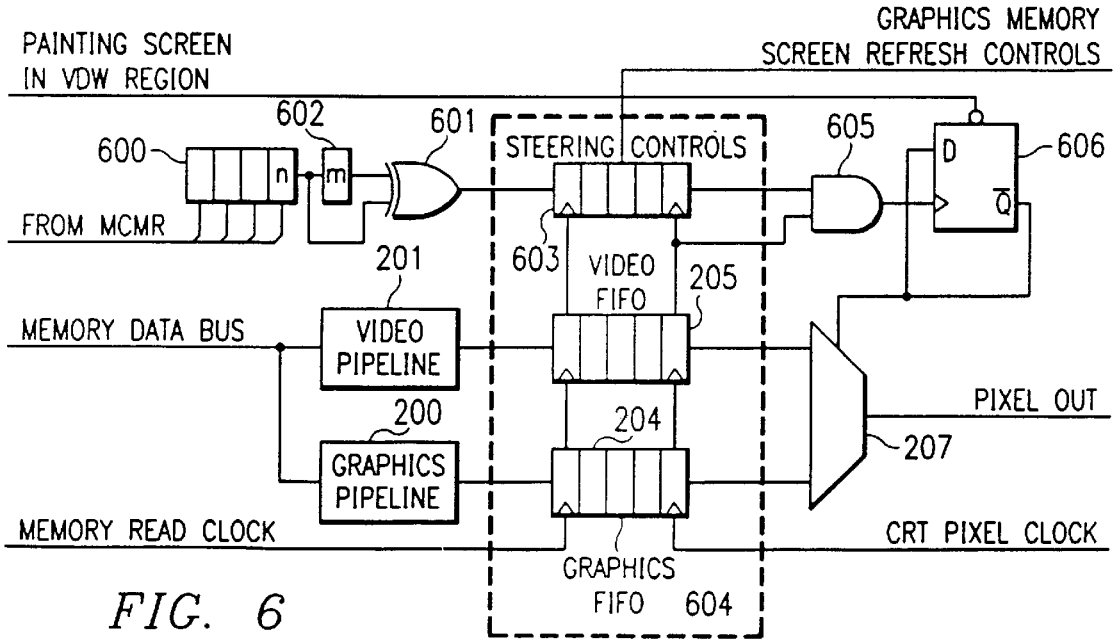
FIG. 6 is a functional block diagram depicting in further detail the overlay selector of FIG. 3.

FIG. 6 is a detailed functional block diagram depicting the interface between mask generated read controls 303, the graphics pipeline and FIFO 202/205 and graphics pipeline and graphics FIFO 202/204/206 with the overlay selector 207. As the mask bits are retrieved from register 507 to generate addresses for the memory read cycles, they are simultaneously sent to register 600 for overlay control. The current bit n in register 600 is compared by exclusive-OR gate 601 with the previous bit m being held in register 602. If the state of the current bit n does not match the state of the previous bit m, a logic one is loaded into steering controls FIFO 603. The steering controls maintain a pixel train going to DAC 206. In the preferred embodiment pixel data is packed in frame buffer 107 for efficiency and therefore are not necessarily in the proper order when they reach video FIFO 205 and graphics FIFO 204. The mask bits received into the steering controls determine which pixels will be placed in the video and graphics FIFOs 205 and 204. In the preferred embodiment, a non-displayed pixel will not be loaded into either FIFO 204 or 205. It should be noted that one bit is placed in steering controls FIFO 603 (preferably a one-bit wide FIFO) for each pixel.

Each mask bit output from steering controls FIFO 303 drives AND gate 605 and flip-flop 606 to control whether video data from video FIFO 205 is to be output to DAC 208 or graphics data is to be output from graphics FIFO 204 to DAC 208. In the illustrated embodiment, the bits output from the steering controls register 603 and the CRT pixel clock are AND-ed together and the result used to toggle flip-flop 606. The output of flip-flop 606 in turn drives the control input to overlay selector 207. As the overlay selector 207 toggles, data is retrieved from either the graphics FIFO 204 or video FIFO 205.

Steering controls FIFO 603 includes a tap labeled in FIG. 6 "Two Graphics Memory Screen Refresh Controls." A steering control 604 includes a toggler similar to that shown in FIG. 6 which controls (605,606) requests for memory read cycles by the graphics screen refresh controls (not shown). The tap is placed in the steering controls FIFO 603 at a point that ensures that the video pipeline 202/204/206 and the graphics pipeline 202/205 are aligned.

Although the preferred embodiment has been described in detail, it should be understood that various changes, substitutions and alterations can be made therein without departing from the spirit and scope of the invention as defined by the appended claims.

What is claimed is:

1. An overlay control system comprising:

a frame buffer for storing words of graphic data, words of video data and an overlay control mask;

mask generation circuitry for generating said overlay control mask for storage in said frame buffer from a mask object, said mask object having fewer bits than said overlay control mask; and mask controlled overlay selection circuitry operable in response to bits of said overlay control mask retrieved from said frame buffer to selectively retrieve and output words of said video data stored in said frame buffer.

2. The overlay control system of claim 1, wherein the mask generation circuitry further comprises:

circuitry for generating a plurality addresses to storage locations within said frame buffer, said locations for storing bits defining a selected region of said overlay control mask;

circuitry for generating mask data words of a selected logic value; and circuitry for selectively presenting said addresses and said mask data words to said frame buffer such that said mask data words are written to said storage locations thereby defining said region of said overlay control mask.

3. The overlay control system of claim 2, wherein said circuitry for generating a plurality of addresses comprises:

an x-position counter for counting, in response to a clock, from an initial x-position value to a final x-position value;

a y-position counter for counting from an initial y-position value to a final y-position value when a count in said x-position counter reaches said final x-position value, said x-position counter resetting to said initial x-position value and continuing to count when a current count in said y-position counter has not reached said final y-position value;

an x-position register for storing a first portion of an address, to a first location in said frame buffer for storing a first bit of said region;

a y-position counter for storing a second portion of said address;

circuitry for modifying said first portion being stored in said x-position register with each change in count of said x-position counter; and circuitry for modifying said second portion being stored in said y-position counter when said count in said x-position counter reaches said final value.

4. The overlay control system of claim 2, further comprising a data formatter having a plurality of storage locations each pointed to by selected bits of an address, said formatter accumulating for output as a data word a selected number of bits of said selected logic value in response to said selected bits of corresponding ones of said addresses.

5. The overlay control system of claim 1, wherein said mask controlled overlay selection circuitry comprises:

display-position control circuitry for determining when a position of a raster scan generating a display screen has reached a video window within said display screen;

circuitry for generating an address to said frame buffer to retrieve corresponding bits of said overlay control mask when said raster scan has reached said video window;

a register for storing said bits of said overlay control mask retrieved from said frame buffer;

circuitry for generating addresses to said frame buffer to retrieve words of said video data corresponding to said video window; and an overlay selector for selectively outputting said words of said video data retrieved from said frame buffer in response to said bits of said overlay control mask stored in the register.

6. The overlay control system of claim 5 and further comprising comparison circuitry for comparing selected ones of said bits stored in said register to bits from display-position control circuitry and generating, in response, a video read request signal to control circuitry associated with said frame buffer, said control circuitry providing in response to said video read request signal, a video read grant signal to circuitry for generating addresses to enable the retrieval of said corresponding bits of said mask.

7. A display system comprising:

a display device for generating a display on a display screen;

a frame buffer having a graphics memory area and a mask memory area;

graphics data processing circuitry for processing a graphics data stream, said graphics data processing circuitry controlling transfer of graphics data to and from the graphics memory area of said frame buffer;

mask generation circuitry for generating a mask for storage in the mask memory area of said frame buffer from a mask object, said mask object having fewer bits than said mask;

video data processing circuitry for processing a video data stream including mask controlled circuitry operable in response to bits of said mask retrieved from said frame buffer to selectively retrieve words of said video data stream stored in said frame buffer; and mask controlled output selection circuitry for selecting for output to said display device in response to said bits of said mask between words of graphics data retrieved from said frame buffer by said graphics processing circuitry and words of said video data retrieved from said frame buffer by said video data processing circuitry.

8. The system of claim 7, wherein the mask generation circuitry further comprises:

circuitry for generating a plurality of addresses to storage locations within a mask object storing bits, defining a selected region of a mask;

circuitry for generating mask data words of a selected logic value; and circuitry for selectively presenting said addresses and said data words to said frame buffer such that said mask data words are written to said storage locations in said mask object to define said selected region of said mask.

9. The display system of claim 8, wherein said circuitry for generating a plurality of addresses comprises:

an x-position counter for counting in response to a clock from an initial x-position value to a final x-position value;

a y-position counter for counting from a initial y-position value to a final y-position value when a count in said x-position counter reaches said final x-position value, said x-position counter resetting to said initial x-position value and continuing to count when a current count in said y-position counter has not reached said final y-position value;

an x-position register for storing a first portion of an address to a first location in said frame buffer for storing a first bit of said region;

a y-position counter for storing a second portion of said address;

circuitry for modifying said first portion being stored in said x-position register with each change in count of said x-position counter; and circuitry for modifying said second portion being stored in said y-position counter when said count in said x-position counter reaches said final value.

10. The display system of claim 8, wherein said circuitry for generating mask data words comprises a data formatter having a plurality of storage locations each pointed to by selected bits of an address, said data formatter accumulating for output as a mask data word a selected number of bits of said selected logic value in response to at least some bits of corresponding ones of said addresses.

11. The display system of claim 10, wherein said data formatter accumulates 64-bit mask data words for storage in said mask object.

12. The display system of claim 7, wherein said mask controlled circuitry of said video processing comprises:

display position control circuitry for determining when a position of a raster scan generating a said display screen on said display device has reached a video window within said display screen;

circuitry for generating an address to said frame buffer to retrieve bits of said mask from said mask object when said raster scan has reached said video window;

a register for storing said bits of said mask retrieved from said frame buffer;

circuitry for generating addresses to said frame buffer to retrieve words of said video data corresponding to said video window; and comparison circuitry for comparing selected ones of said bits retrieved from said register to bits from display-position control circuitry and generating in response a video read request to control circuitry associated with said frame buffer, said control circuitry providing in response to said read request a video read grant to circuitry for generating addresses to enable the retrieval of said video data corresponding to said video window.

13. The display system of claim 12, wherein said mask controlled output selection circuitry received said bits of said mack from said register an performs an output selection in response thereto.

14. The display system of claim 12, wherein said register stores mask bits as 64-bit blocks received from said mask object.

15. The display system of claim 12, wherein said comparison circuitry compares 4 said selected bits at a time.

* * * * *